US009711880B2

(12) United States Patent
Kiryu et al.

(10) Patent No.: US 9,711,880 B2
(45) Date of Patent: Jul. 18, 2017

(54) CONNECTOR WITH FLOATING HOUSING

(71) Applicant: FUJITSU COMPONENT LIMITED, Tokyo (JP)

(72) Inventors: Koichi Kiryu, Nagano (JP); Takahiro Kondo, Tokyo (JP); Koki Sato, Tokyo (JP); Mitsuru Kobayashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/309,501

(22) PCT Filed: May 15, 2015

(86) PCT No.: PCT/JP2015/064078
§ 371 (c)(1),
(2) Date: Nov. 8, 2016

(87) PCT Pub. No.: WO2015/186493
PCT Pub. Date: Dec. 10, 2015

(65) Prior Publication Data

US 2017/0141496 A1 May 18, 2017

(30) Foreign Application Priority Data

Jun. 2, 2014 (JP) ..... 2014-114184

(51) Int. Cl.
*H01R 12/71* (2011.01)
*H01R 13/631* (2006.01)

(52) U.S. Cl.
CPC ..... *H01R 12/716* (2013.01); *H01R 13/6315* (2013.01)

(58) Field of Classification Search
CPC ... H01R 3/6315; H01R 12/91; H01R 12/7161
(Continued)

(56) References Cited

U.S. PATENT DOCUMENTS 6,155,858 A * 12/2000 Ozawa ..... H01R 13/6315 439/248
8,257,095 B2 * 9/2012 Akai ..... H01R 12/716 439/248

(Continued)

FOREIGN PATENT DOCUMENTS

JP 2011-048982 3/2011
JP 2012-014898 1/2012

(Continued)

*Primary Examiner* — Harshad Patel
(74) *Attorney, Agent, or Firm* — IPUSA, PLLC

(57) ABSTRACT

A connector includes a plurality of contacts each including a contacting portion, provided at one end, that contacts a counterpart connector, a lead portion, provided at another end, that contacts a substrate, and a spring portion, provided between the contacting portion and the lead portion, that elastically deforms; a floating housing, fixed to the contacting portions of the plurality of contacts that are aligned in two columns of contacts, that fits with the counterpart connector; a first fixed housing, provided between the two columns of contacts, that is fixed to the substrate, and a second fixed housing, fixed to the first fixed housing, that sandwiches a portion adjacent to the lead portion of each of the plurality of contacts with the first fixed housing.

6 Claims, 19 Drawing Sheets

(58) Field of Classification Search
USPC ..... 439/247
See application file for complete search history.

(56) References Cited

U.S. PATENT DOCUMENTS

| | | | | |
|---|---|---|---|---|
| 2006/0276061 | A1* | 12/2006 | Koguchi | H01R 12/725 439/74 |
| 2011/0294326 | A1* | 12/2011 | Tanaka | H01R 12/712 439/248 |
| 2012/0003875 | A1 | 1/2012 | Akai et al. | |
| 2014/0213115 | A1 | 7/2014 | Kimura | |
| 2014/0242845 | A1* | 8/2014 | Miki | H01R 24/66 439/629 |
| 2015/0064935 | A1 | 3/2015 | Funayama et al. | |

FOREIGN PATENT DOCUMENTS

| | | |
|---|---|---|
| JP | 2014-067706 | 4/2014 |
| JP | 2014-146472 | 8/2014 |

* cited by examiner

CONNECTOR WITH FLOATING HOUSING

FIELD

The present invention relates to a connector.

BACKGROUND

A floating connector is known which is a connector used for connecting substrates and which includes a floating housing provided to be displaceable with respect to a fixed housing fixed to a substrate in order to absorb positional displacement with respect to a counterpart connector (another connector that is connected to the respective connector) (see Patent Document 1, for example). In the above described floating connector, the floating housing is provided to be displaceable in a pitch direction in which contacts are aligned, in a dual direction that is perpendicular to the pitch direction and in an insertion-extraction direction in which the connector is inserted in and extracted from.

PATENT DOCUMENT

Patent Document 1: Japanese Laid-open Patent Publication No. 2011-48982

However, the positional displacement with respect to the counterpart connector may occur in various directions, and is not limited to the above described pitch direction, the dual direction and the insertion-extraction direction. Thus, according to the above described floating connector, the floating housing cannot be smoothly displaced in accordance with the positional displacement occurred in various directions, and connection reliability may be lowered by being damaged or the like when fitting with the counterpart connector.

SUMMARY

One aspect of the disclosure is to provide a connector capable of increasing connection reliability by absorbing mounting positional displacement with respect to a counterpart connector occurred in various directions.

According to one aspect of the disclosure, there is provided a connector including a plurality of contacts each including a contacting portion, provided at one end, that contacts a counterpart connector, a lead portion, provided at another end, that contacts a substrate, and a spring portion, provided between the contacting portion and the lead portion, that elastically deforms; a floating housing, fixed to the contacting portions of the plurality of contacts that are aligned in two columns of contacts, that fits with the counterpart connector; a first fixed housing, provided between the two columns of contacts, that is fixed to the substrate, and a second fixed housing, fixed to the first fixed housing, that sandwiches a portion adjacent to the lead portion of each of the plurality of contacts with the first fixed housing.

According to one aspect of the disclosure, a connector capable of increasing connection reliability by absorbing mounting positional displacement with respect to a counterpart connector occurred in various directions is provided.

BRIEF DESCRIPTION OF DRAWINGS

FIG. 90 is a bottom view of the floating housing of the embodiment;

DESCRIPTION OF EMBODIMENTS

Figure 1:
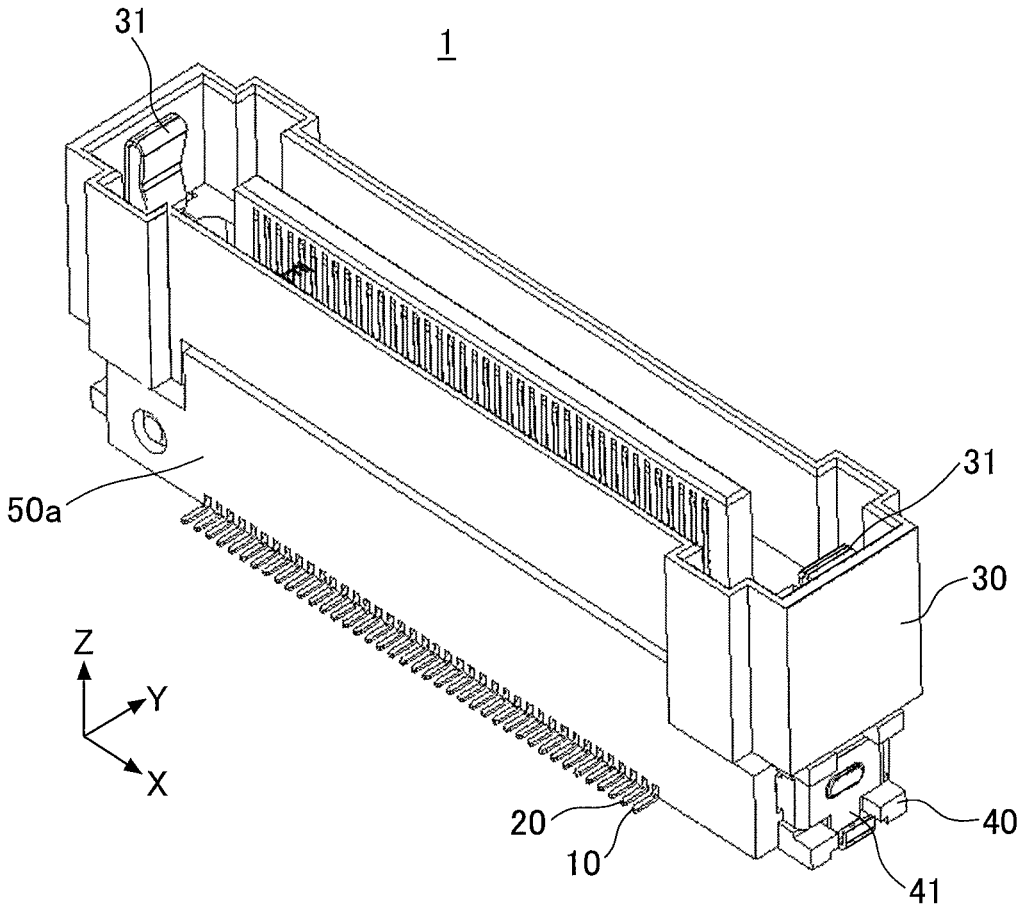
FIG. 1 is a perspective view illustrating an example of a connector of an embodiment.

The invention will be described herein with reference to illustrative embodiments. It is to be noted that, in the explanation of the drawings, the same components are given the same reference numerals, and explanations are not repeated.

(Structure of Connector)

First, an entire structure of a connector 1 of the embodiment is described with reference to FIG. 1 to FIG. 4.

Figure 2:
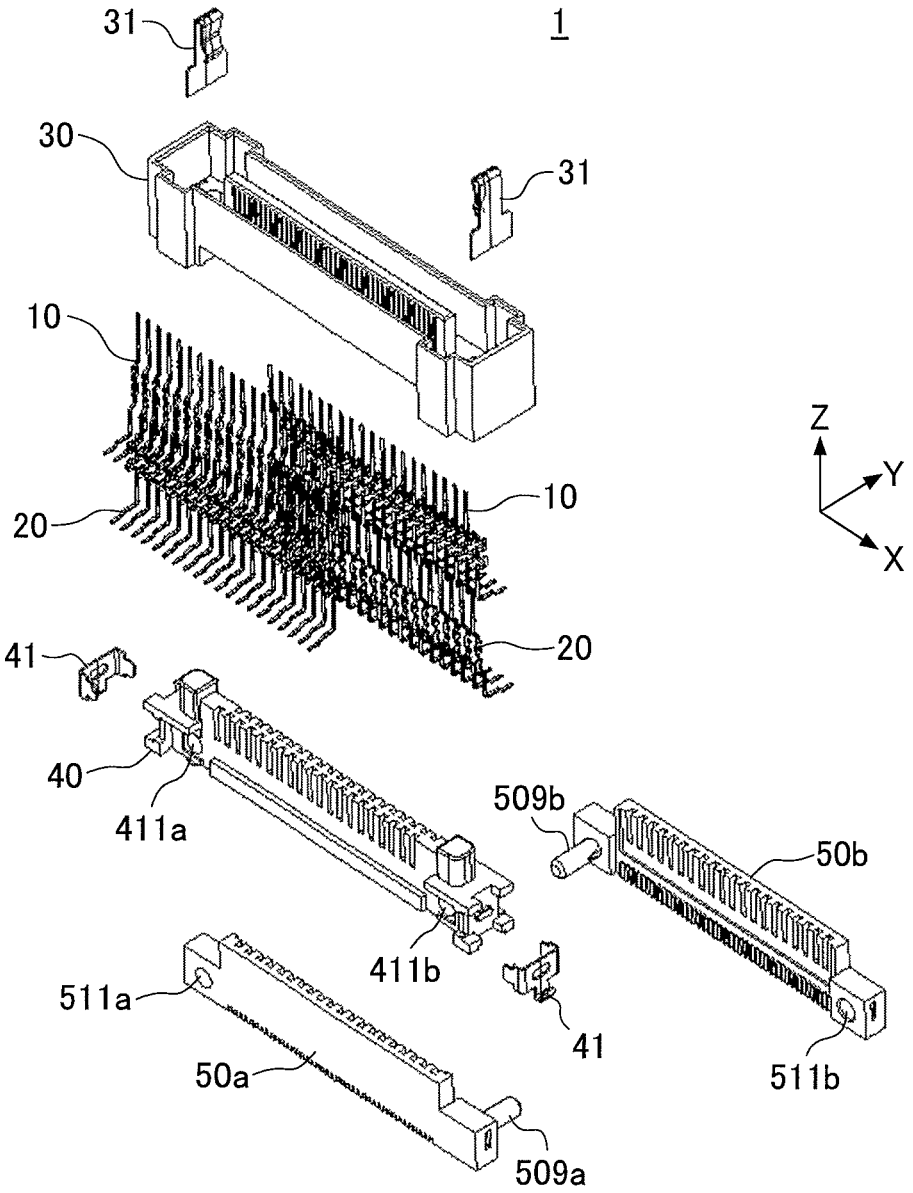
FIG. 2 is an exploded perspective view illustrating an example of the connector of the embodiment.
Figure 3A:
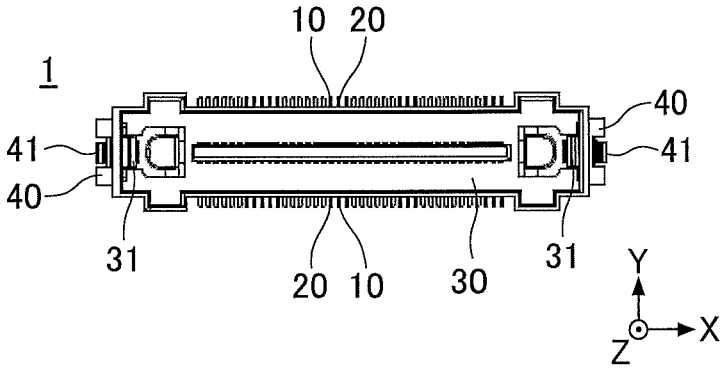
FIG. 3A is a top view of the connector of the embodiment.
Figure 3B:
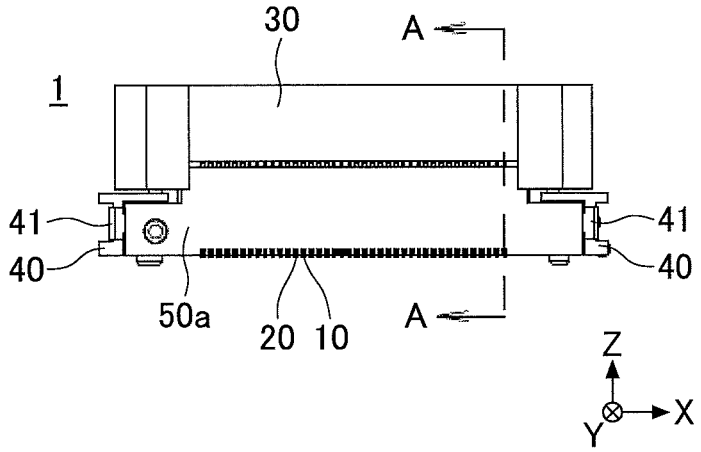
FIG. 3B is an elevation view of the connector of the embodiment.
Figure 3C:
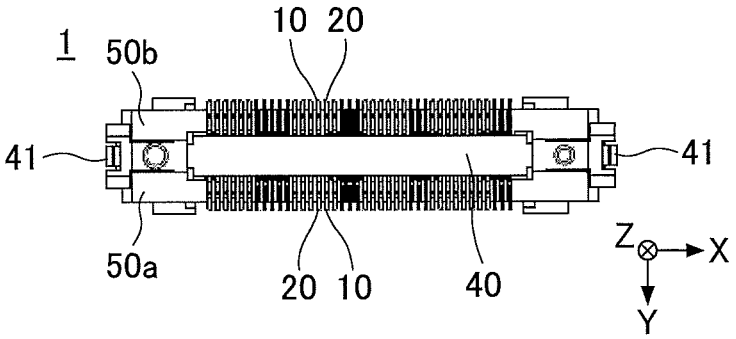
FIG. 3C is a bottom view of the connector of the embodiment.
Figure 3D:
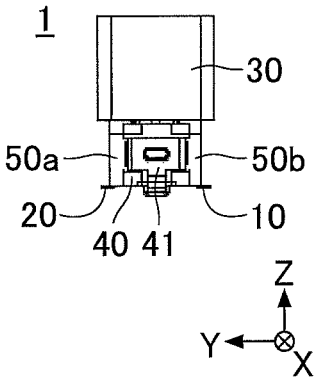
FIG. 3D is a side view of the connector of the embodiment.
Figure 4:
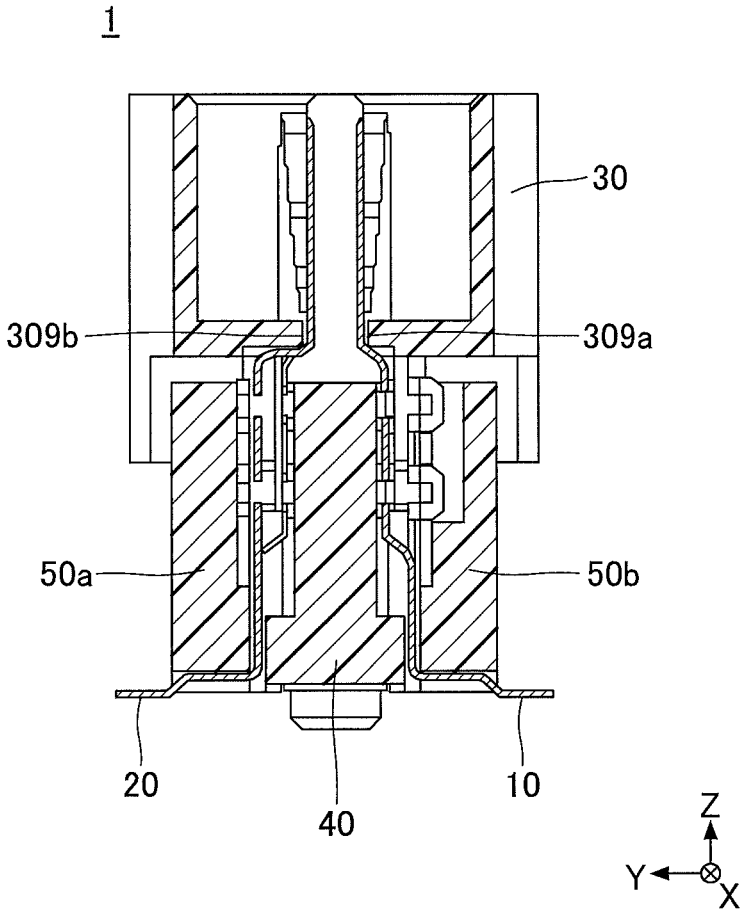
FIG. 4 is an A-A cross-sectional view of FIG. 3B.

FIG. 1 is a perspective view illustrating an example of the connector 1 of the embodiment. FIG. 2 is an exploded perspective view of the connector 1 of the embodiment. FIG. 3A is a top view, FIG. 3B is an elevation view, FIG. 3C is a bottom view and FIG. 3D is a side view, of the connector 1. FIG. 4 is an A-A cross-sectional view of FIG. 3B.

As illustrated in FIG. 1 to FIG. 4, the connector 1 includes first contacts 10, second contacts 20, a floating housing 30, engaging metal fittings 31, a first fixed housing 40, fixed pawls 41 and second fixed housings 50*a* and 50*b* (hereinafter, generally referred to as a "second fixed housing 50" as well).

In the drawings, an X direction is a width direction of the connector 1, and a Y direction is a depth direction of the connector 1. Further, a Z direction is a height direction of the connector 1 and also an insertion-extraction direction in which a counterpart connector (another connector that is connected to the connector 1) is inserted in and extracted from the connector 1. Further, in the following description, a floating housing 30 side is referred to as an upper side, and a first fixed housing 40 side and a second fixed housing 50 side are referred to as a lower side, in the Z direction, as well.

As illustrated in FIG. 1 to FIG. 4, two columns of contacts, in each of which the first contacts 10 and the second contacts 20 are alternatively aligned in the X direction, are provided in the connector 1.

Each of the first contacts 10 and the second contacts 20 is provided with a contacting portion that contacts a terminal of the counterpart connector at an upper end, a lead portion that is bonded to a substrate at a lower end, and a spring portion that elastically deforms between the contacting portion and the lead portion. Each of the first contacts 10 and the second contacts 20 is fixed to the floating housing 30 at a contacting portion side with respect to the spring portion, and is fixed to the first fixed housing 40 and the second fixed housing 50 at a lead portion side with respect to the spring portion.

The floating housing 30 is fixed at an upper end of each of the first contacts 10 and the second contacts 20, and the counterpart connector is inserted in and extracted from in the Z direction. The floating housing 30 has a shape that fits the counterpart connector, which is inserted in and extracted from in the Z direction, and as illustrated in FIG. 1 and FIG. 2, the floating housing 30 is provided with the engaging metal fittings 31 that engage the counterpart connector at both end portions in the X direction. The engaging metal fitting 31 is a plate spring formed by a plate metal member, and engages a side portion of the counterpart connector.

The lead portion side of each of the first contacts 10 and the second contacts 20 is connected to the substrate with the first fixed housing 40 and the second fixed housing, and the floating housing 30 is fixed to an upper end side of each of the first contacts 10 and the second contacts 20 with respect to the spring portion. As the spring portion of each of the first contacts 10 and the second contacts 20 elastically deforms, the floating housing 30 fixed to the contacting portion side is displaceable with respect to the substrate in the entire directions.

The first fixed housing 40 is provided between the two columns of contacts, in each of which the first contacts 10 and the second contacts 20 are alternatively aligned in the X direction. The first fixed housing 40 is provided with the fixed pawls 41 at both end portions in the X direction. The fixed pawl 41 is formed by a plate metal member, fixed at an end portion of the first fixed housing 40, and fixes the first fixed housing 40 to the substrate by engaging a folding portion at a lower end portion with an engaging hole provided at the substrate, for example.

The second fixed housings 50*a* and 50*b* have the same shape, and as illustrated in FIGS. 3C and 3D and FIG. 4, the second fixed housings 50*a* and 50*b* sandwich each of the first contacts 10 and the second contacts 20 at the lead portion side with respect to the spring portion between the first fixed housing 40 to be fixed to the first fixed housing 40.

The connector 1 has the above described configuration, and the lower end of each of the first contacts 10 and the second contacts 20 is fixed to the substrate with the first fixed housing 40 and the second fixed housing 50. As the spring portion of each of the first contacts 10 and the second contacts 20 elastically deforms, the floating housing 30 fixed at the upper end of each of the first contacts 10 and the second contacts 20 is displaceable with respect to the substrate in the entire directions.

(Contact)

Next, a structure of the first contact 10 and the second contact 20 is described.

(First Contact)

Figure 5:
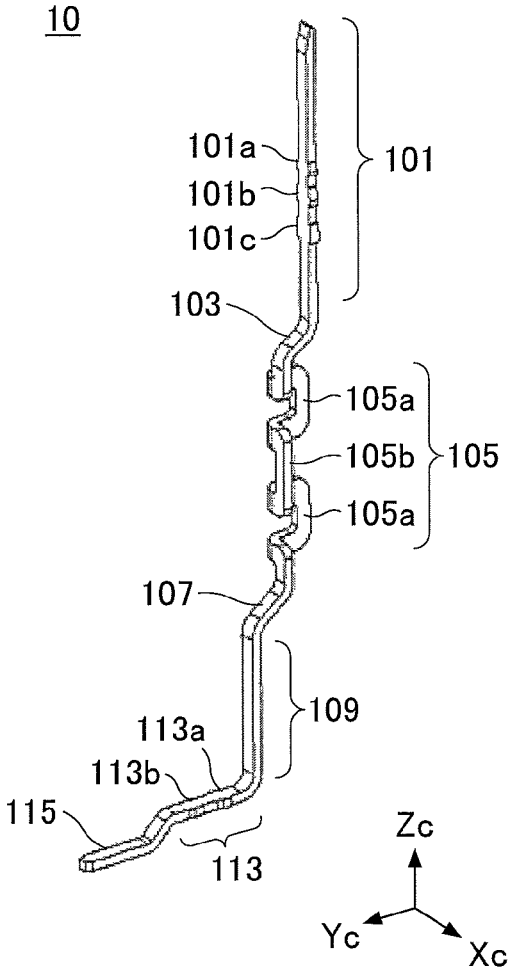
FIG. 5 is a view illustrating an example of a first contact of the embodiment.
Figure 6A:
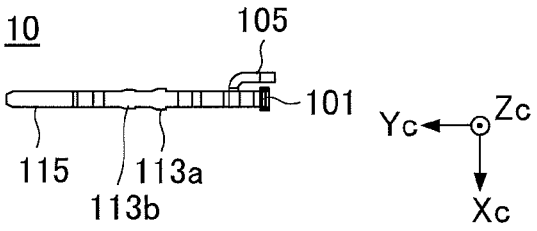
FIG. 6A is a top view of the first contact of the embodiment.
Figure 6B:
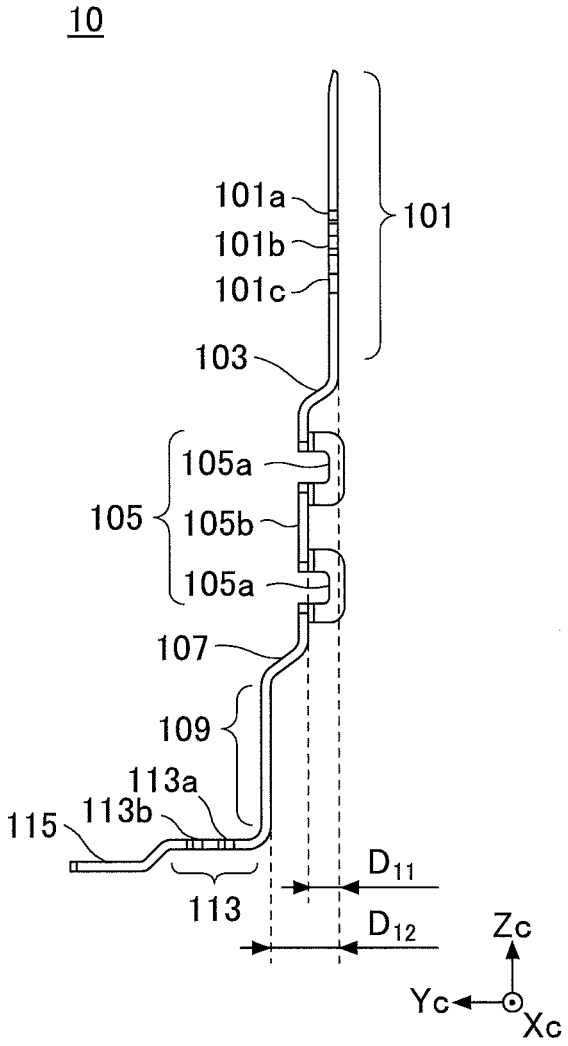
FIG. 6B is an elevation view of the first contact of the embodiment.
Figure 6C:
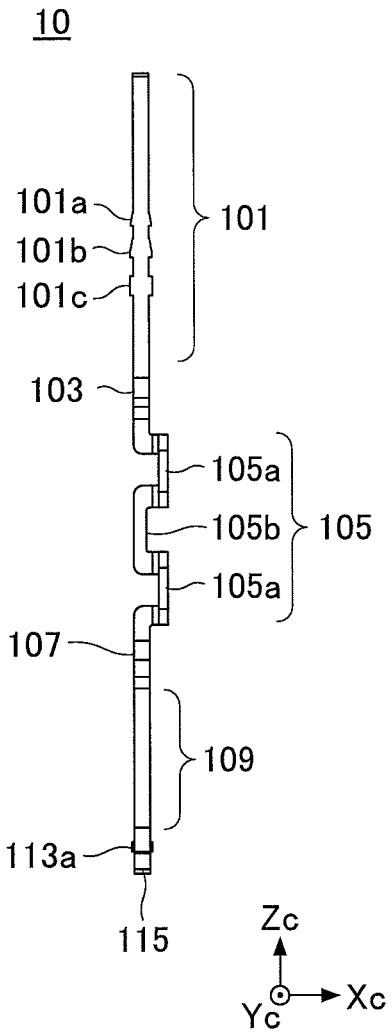
FIG. 6C is a side view of the first contact of the embodiment.

FIG. 5 is a perspective view illustrating an example of the first contact 10 of the embodiment. Further, FIG. 6A is a top view, FIG. 6B is an elevation view, and FIG. 6C is a side view, of the first contact 10.

The first contact 10 is formed by a plate metal member by stamping and folding, and as illustrated in FIG. 5 and FIGS. 6A to 6C, the first contact 10 includes a contacting portion 101, a bending portion 103, a spring portion 105, a bending portion 107, a first fixed portion 109, a second fixed portion 113 and a lead portion 115.

In FIG. 5 and FIGS. 6A to 6C, an Xc direction is a width direction of the first contact 10, a Yc direction is a thickness direction of the contacting portion 101 and a Zc direction is a drawing direction of the contacting portion 101, and each of the directions is perpendicular to other directions, respectively.

Further, in the following description, a contacting portion 101 side is referred to as an upper side and a lead portion 115 side is referred to as a lower side, in the Zc direction, as well.

The contacting portion 101 is provided at one end (an upper end in FIG. 5 and FIGS. 6A to 6C) of the first contact 10, formed to linearly draw in the Zc direction, and inserted in a contact groove from a contact hole provided in the floating housing 30. The contacting portion 101 includes pawl portions 101*a*, 101*b* and 101*c*, each of which protrudes from both sides of the contacting portion 101 in the Xc direction, and the contacting portion 101 is fixed to the floating housing 30 as the pawl portions 101*a*, 101*b* and 101*c* are pushed in the contact groove of the floating housing 30. One surface (a surface at left in FIG. 6B) of the contacting portion 101 is exposed in the floating housing 30, and contacts a terminal or the like of the counterpart connector that is inserted in the floating housing 30.

The bending portion 103 is provided at a lower side of the contacting portion 101, and the spring portion 105 is provided at a lower side of the bending portion 103. The spring portion 105 includes two first spring portions 105*a* that are apart from each other in the Zc direction, and a second spring portion 105*b* that connects the two first spring portions 105*a*.

The first spring portion 105*a* is formed by stamping to include a curved portion that protrudes in a direction perpendicular to the drawing direction (the Zc direction in FIG. 5 and FIGS. 6A to 6C) of the contacting portion 101, and the curved portion is folded by folding in an opposite side (−Yc direction, right in FIG. 6B) of a drawing direction of the lead portion 115. In other words, the curved portion of the first spring portion 105*a* is folded such that its thickness direction becomes substantially parallel to the Xc direction that is perpendicular to the Yc direction, which is the thickness direction of the contacting portion 101.

Similar to the first spring portion 105*a*, the second spring portion 105*b* is formed by stamping to include a curved portion, but different from the first spring portion 105*a*, the curved portion is not folded and the curved portion faces in a direction perpendicular to the first spring portion 105*a*. Thus, for the example of FIGS. 6A to 6C, the thickness direction of the curved portion of the second spring portion 105*b* is the same as the thickness direction of the contacting portion 101 and is perpendicular to the thickness direction of the curved portion of the first spring portion 105*a*.

As the first spring portions 105*a* and the second spring portion 105*b* elastically deform, the spring portion 105 is capable of bending in the entire directions on an XcYc plane, extendable in the Zc direction and elastically deformable to be twisted.

The number of each of the first spring portions 105*a* and the second spring portions 105*b* provided in the spring portion 105 is not limited to the configuration exemplified in this embodiment. The spring portion 105 may include three or more of the first spring portions 105*a* and two or more of the second spring portions 105*b*, for example.

The bending portion 107 is provided at a lower side of the spring portion 105, and the first fixed portion 109 is provided at a lower side of the bending portion 107. The first fixed portion 109 linearly draws in a direction (Zc direction) substantially parallel to the drawing direction of the contacting portion 101, and is sandwiched between the first fixed housing 40 and the second fixed housing 50.

The second fixed portion 113 is provided at a lower side of the first fixed portion 109. The second fixed portion 113 draws in a direction substantially parallel to the Yc direction, and as illustrated in FIG. 6A, includes pawl portions 113*a* and 113*b* provided at both sides in the Xc direction. The second fixed portion 113 is inserted in a contact groove provided at a lower surface of the second fixed housing 50. The second fixed portion 113 is fixed to the second fixed housing 50 as the pawl portions 113*a* and 113*b* are pushed in the contact groove.

The lead portion 115 is provided at a lower side of the second fixed portion 113. The lead portion 115 is formed to draw in a direction substantially parallel to the Yc direction, and is exposed from the second fixed housing 50 to be bonded to the substrate.

(Second Contact)

Figure 7:
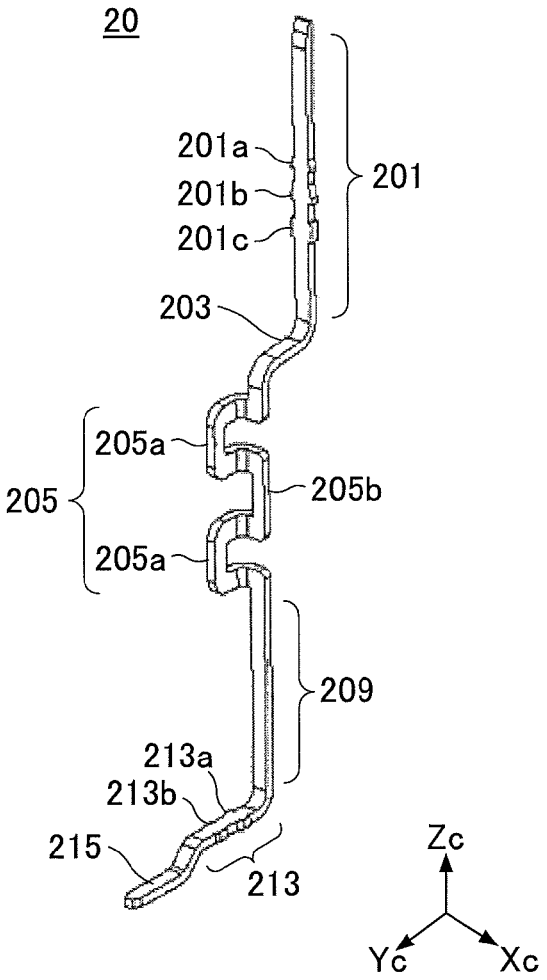
FIG. 7 is a view illustrating an example of a second contact of the embodiment.
Figure 8A:
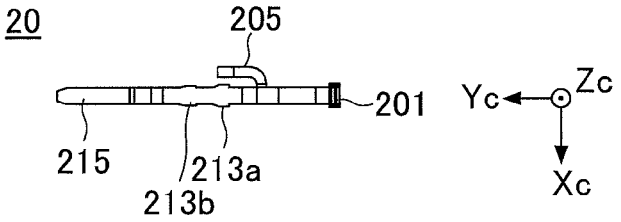
FIG. 8A is a top view of the second contact of the embodiment.
Figure 8B:
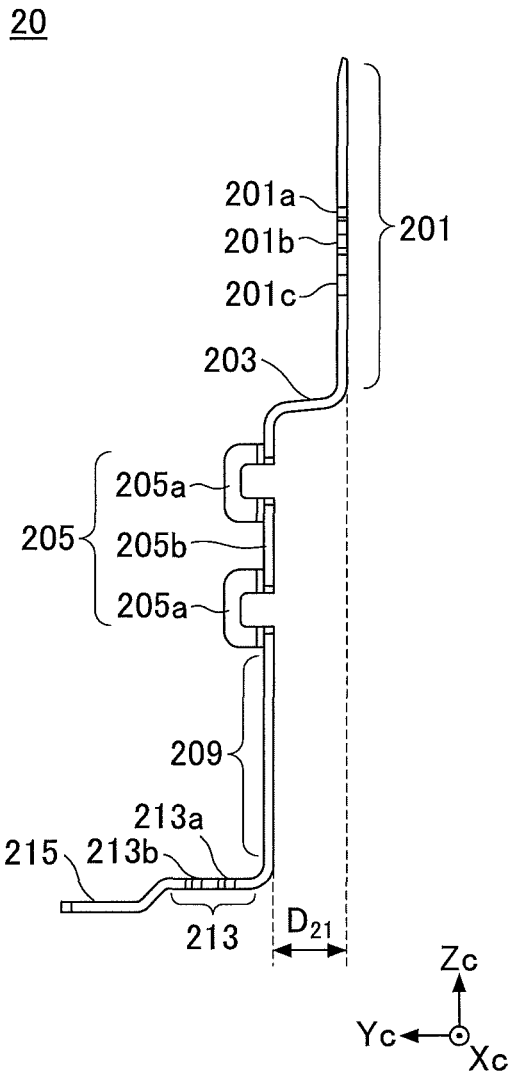
FIG. 8B is an elevation view of the second contact of the embodiment.
Figure 8C:
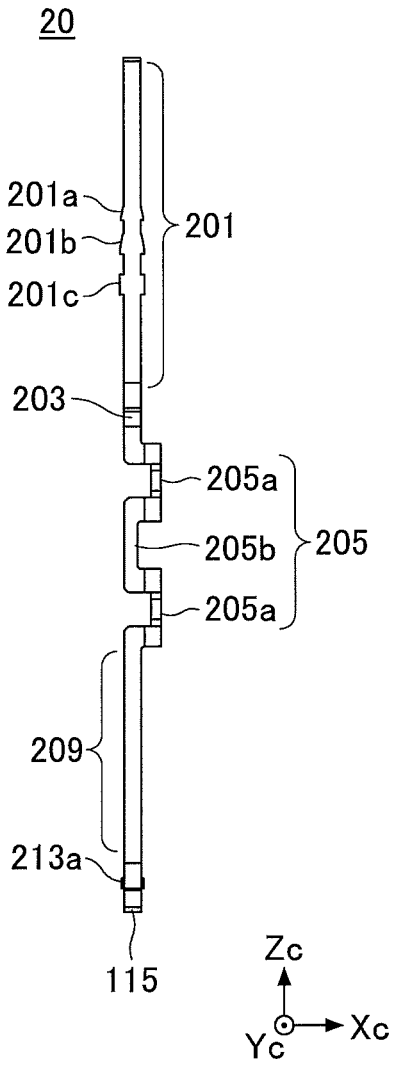
FIG. 8C is a side view of the second contact of the embodiment.

FIG. 7 is a perspective view illustrating an example of the second contact 20 of the embodiment. Further, FIG. 8A is a top view, FIG. 8B is an elevation view, and FIG. 8C is a side view, of the second contact 20.

Similar to the first contact 10, the second contact 20 is formed by a plate metal member by stamping and folding, and as illustrated in FIG. 7 and FIGS. 8A to 8C, the second contact 20 includes a contacting portion 201, a bending portion 203, a spring portion 205, a first fixed portion 209, a second fixed portion 213 and a lead portion 215.

Here, similar to the first contact 10, in FIG. 7 and FIGS. 8A to 8C, the Xc direction is a width direction of the second contact 20, the Yc direction is a thickness direction of the contacting portion 201 and the Zc direction is a drawing direction of the contacting portion 201, and each of the directions is perpendicular to other directions, respectively.

Further, in the following description, a contacting portion 201 side is referred to as an upper side and a lead portion 215 is referred to as a lower side, in the Zc direction, as well.

Similar to the contacting portion 101 of the first contact 10, the contacting portion 201 includes pawl portions 201*a*, 201*b* and 201*c*, and is fixed to the floating housing 30 to contact a terminal of the counterpart connector.

The bending portion 203 is provided at a lower side of the contacting portion 201, and a spring portion 205 is provided at a lower side of the bending portion 203. The spring portion 205 includes two first spring portions 205*a* that are apart from each other in the Zc direction, and a second spring portion 205*b* that connects the two first spring portions 205*a*.

The first spring portion 205*a* is formed by stamping to include a curved portion that protrudes in a direction perpendicular to the drawing direction of the contacting portion 201 (the Zc direction in FIG. 7 and FIGS. 8A to 8C), and the curved portion is folded by folding in a drawing direction (Yc direction, left in FIG. 8B) of the lead portion 215. In other words, the curved portion of the first spring portion 205*a* is folded such that its thickness direction becomes substantially parallel to the Xc direction that is perpendicular to the Yc direction, which is the thickness direction of the contacting portion 201.

Similar to the first contact, the second spring portion 205*b* is formed by stamping in the same shape as the first spring portion 205*a*. However, for the second spring portion 205*b*, the curved portion is not folded and the curved portion faces a direction that is almost perpendicular to the curved portion of the first spring portion 205*a*. Thus, in FIG. 7, the thickness direction of the curved portion of the second spring portion 205*b* is the same as the thickness direction of the contacting portion 201, in other words, the Yc direction, and is perpendicular to the thickness direction of the curved portion of the first spring portion 205*a*. As the first spring portions 205*a* and the second spring portion 205*b* elastically deform, the spring portion 205 is capable of bending in the entire directions on the XcYc plane, extendable in the Zc direction and elastically deformable to be twisted.

The number of each of the first spring portions 205*a* and the second spring portions 205*b* provided in the spring portion 205 is not limited to the configuration exemplified in this embodiment. The spring portion 205 may include three or more of the first spring portions 205*a* and two or more of the second spring portions 205*b*, for example, and may have a configuration different from that of the spring portion 105 of the first contact 10.

The first fixed portion 209 is provided at a lower side of the spring portion 205 of the second contact 20. The first fixed portion 209 linearly draws in a direction substantially parallel to a drawing direction (Zc direction) of the contacting portion 201 from a lower end of the spring portion 205, and is sandwiched between the first fixed housing 40 and the second fixed housing 50.

Similar to the first contact 10, the second fixed portion 213 including pawl portions 213*a* and 213*b* and the lead portion 215 are provided at a lower side of the first fixed portion 209. The second fixed portion 213 is fixed at a contact groove provided at a lower surface of the second fixed housing 50. The lead portion 215 is exposed from the second fixed housing 50 to be bonded to the substrate.

Here, as illustrated in FIG. 6R, in the first contact 10, it is assumed that the distance between the contacting portion 101 and the second spring portion 105*b* is "$D_{11}$", and the distance between the contacting portion 101 and the first fixed portion 109 is "$D_{12}$", in the thickness direction (Yc direction) of the contacting portion 101. Further, as illustrated in FIG. 8B, in the second contact 20, it is assumed that the distance between the contacting portion 201 and the second spring portion 205*b*, in the thickness direction (Yc direction) of the contacting portion 201 is "$D_{21}$". At this time, the bending portions 103 and 107 of the first contact 10, and the bending portion 203 of the second contact 20 are provided to satisfy ($D_{11}<D_{12}=D_{21}$). In other words, when aligning positions of the contacting portions 101 and 201 in the Yc direction, a position where the spring portion 105 of the first contact 10 and a position where the spring portion 205 of the second contact 20 is formed are apart from each other by the distance "$D_{12}-D_{11}$" in the Yc direction.

Further, the first spring portions 105*a* of the first contact 10 and the first spring portions 205*a* of the second contact 20 are formed to fold in opposite directions from each other (−Yc direction and +Yc direction) along the drawing directions of the lead portions 115 and 215.

As described above, the lead portions 115 and 215 of the first contact 10 and the second contact 20, respectively, are fixed to the substrate, and the lead portions 115 and 215 are fixed to the first fixed housing 40 and the second fixed housing 50, that are fixed to the substrate. Further, the contacting portions 101 and 201 of the first contact 10 and the second contact 20, respectively, are fixed to the floating housing 30. Due to the spring portions 105 and 205 that elastically deform, the first contact 10 and the second contact 20 support the floating housing 30 in a displaceable manner with respect to the substrate.

Figure 12:
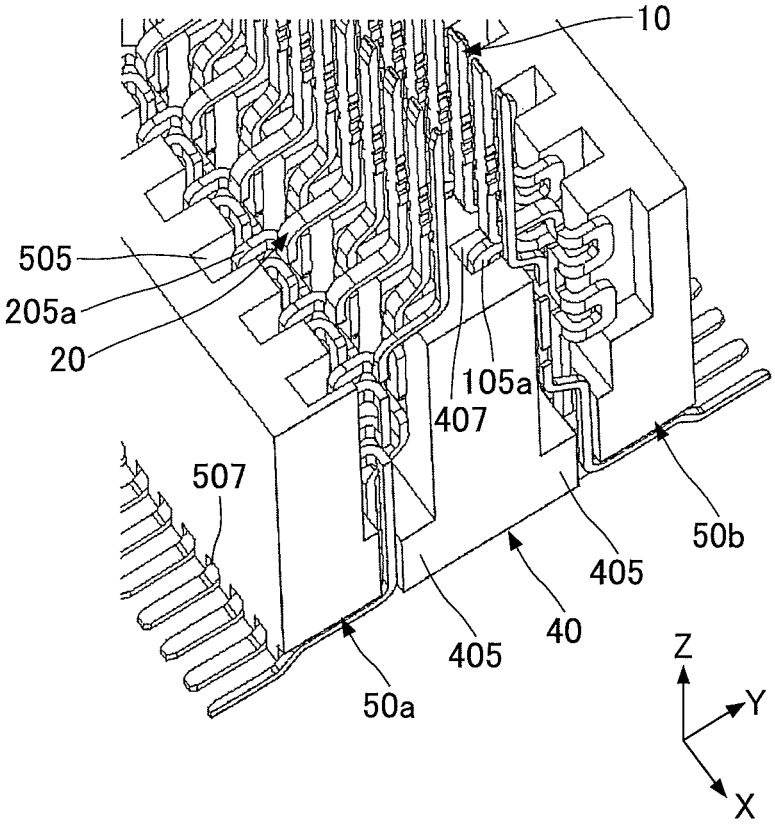
FIG. 12 is a perspective view illustrating a state in which the first contact, the second contact, the first fixed housing and the second fixed housing of the embodiment are combined.
Figure 13:
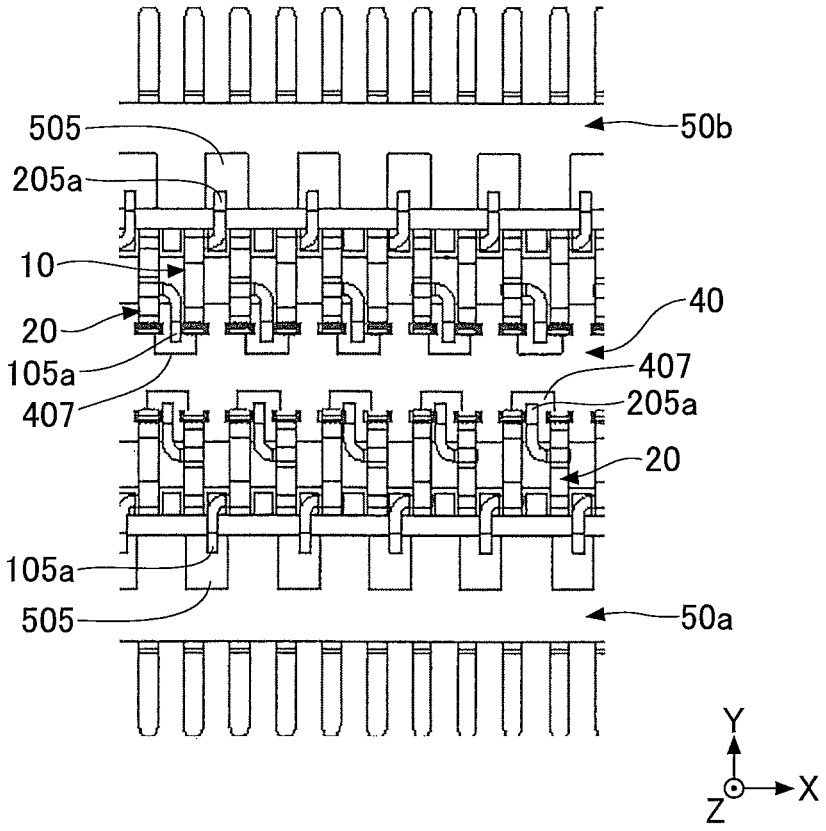
FIG. 13 is a top view illustrating the state in which the first contact, the second contact, the first fixed housing and the second fixed housing of the embodiment are combined.

FIG. 12 and FIG. 13 are a perspective view and a top view, respectively, illustrating a state in which the first contacts 10, the second contacts 20, the first fixed housing 40 and the second fixed housing 50 are combined.

As illustrated in FIG. 12 and FIG. 13, for the first contacts 10 and the second contacts 20, by having the configuration as illustrated in FIG. 5 to FIG. 8C, the spring portions 105 and 205 are provided at different positions in the Y direction of the connector 1.

Further, the first spring portions 105*a* and 205*a* of the first contact 10 and the second contact 20, respectively, are folded in opposite directions. With this configuration, the adjacent spring portion 105 of the first contact 10 and the spring portion 205 of the second contact 20 do not contact even when they elastically deform so that short circuit of the first contact 10 and the second contact 20 is prevented. Further, as the short circuit of the first contact 10 and the second contact 20 is prevented with the above described configuration, the connector 1 of the embodiment can be made small by narrowing a space between the first contact 10 and the second contact 20 in the column of contacts in the X direction.

(Floating Housing)

Figure 9A:
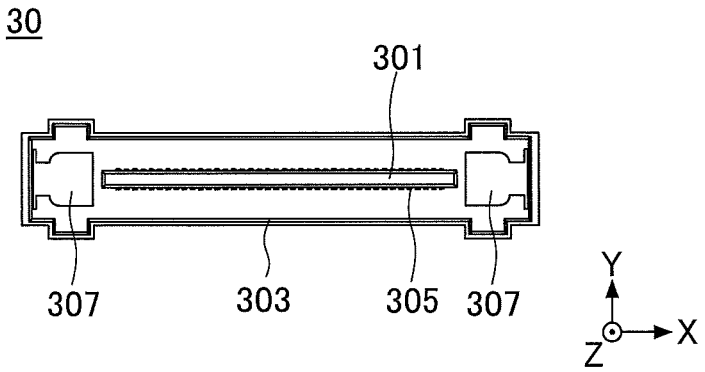
FIG. 9A is a top view of a floating housing of the embodiment.
Figure 9B:
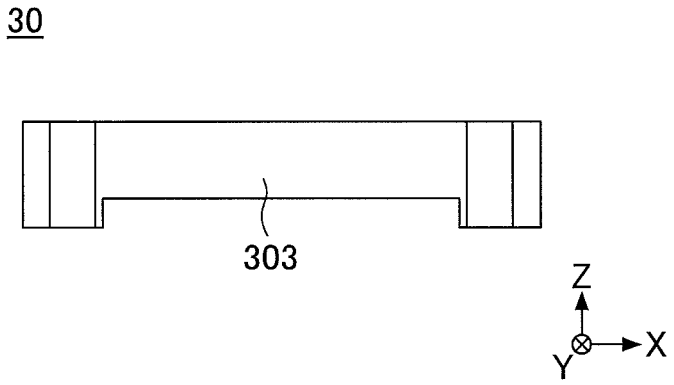
FIG. 9B is an elevation view of the floating housing of the embodiment.
Figure 9C:
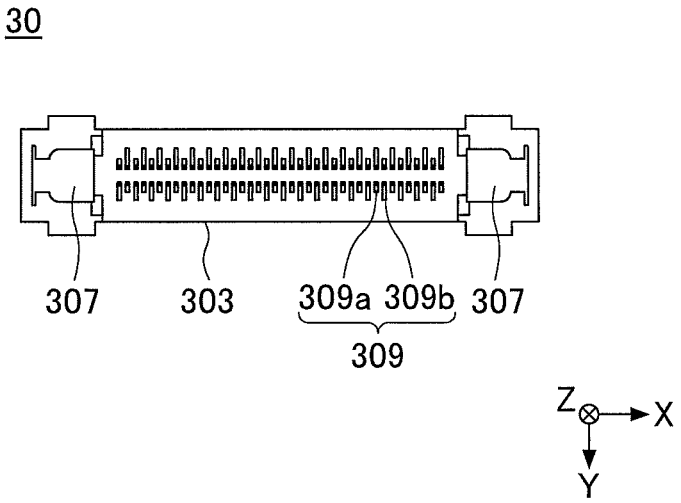
FIG. 9D is a side view of the floating housing of the embodiment.
Figure 9D:
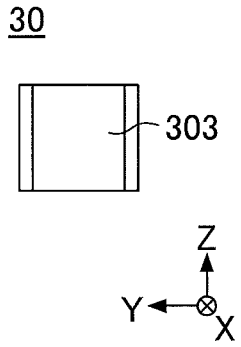

Next, the floating housing 30 is described. FIG. 9A is a top view, FIG. 93 is an elevation view, FIG. 9C is a bottom view and FIG. 9D is a side view, of the floating housing 30.

The floating housing 30 includes a center wall portion 301 that draws in the X direction in an upper plane view, a sidewall portion 303 that surrounds the center wall portion 301, hole portions 307 provided at both end portions in the X direction, and contact holes 309 in which the first contacts 10 and the second contacts 20 are inserted.

The center wall portion 301 protrudes in the Z direction (upper direction) from a bottom surface of the floating housing 30, and is provided with plurality of contact grooves 305 in which the first contacts 10 and the second contacts 20 are inserted at both surfaces in the Y direction. The contact grooves 305 are formed along the Z direction to be connected to the contact holes 309 provided at the bottom surface of the floating housing 30, respectively.

The contact holes 309 include first contact holes 309*a* and second contact holes 309*b* that are alternatively provided in the X direction. The first contact 10 is inserted in the first contact hole 309*a* and the second contact 20 is inserted in the second contact hole 309*b*. Two columns of the contact holes 309 aligned in the X direction, apart from each other in the Y direction, are provided at the bottom surface of the floating housing 30.

As illustrated in FIG. 4, grooves in which the bending portion 103 of the first contact 10 and the bending portion 203 of the second contact 20 are inserted are provided at a lower portion of the first contact hole 309*a* and the second contact hole 309*b*, respectively, in accordance with the lengths of the bending portions 103 and 203 in the Y direction, respectively.

The contacting portion 101 is inserted in the contact groove 305 through the first contact hole 309*a*, and the first contact 10 is fixed to the contact groove 305 by the pawl portions 101*a*, 101*b* and 101*c*. Further, similarly, the contacting portion 201 is inserted in the contact groove 305 through the second contact hole 309*b*, and the second contact 20 is fixed to the contact groove 305 by the pawl portions 201*a*, 201*b* and 201*c*.

As described above, the contacting portion 101 of the first contact 10 and the contacting portion 201 of the second contact 20, that are inserted in the contact grooves 305 from the contact holes 309, are fixed to the floating housing 30. Further, the floating housing 30 is supported in a displaceable manner with respect to the substrate and the first and second fixed housings 40 and 50 by the first contacts 10 and the second contacts 20 in which the spring portions 105 and 205 elastically deform.

(Fixed Housing)

Next, the first fixed housing 40 and the second fixed housing 50 are described.

(First Fixed Housing)

Figure 10A:
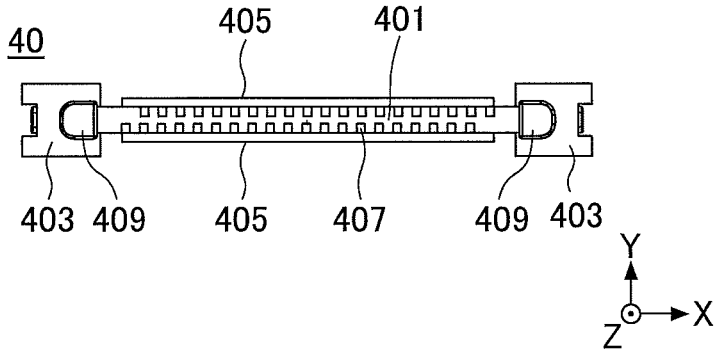
FIG. 10A is a top view of a first fixed housing of the embodiment.
Figure 10B:
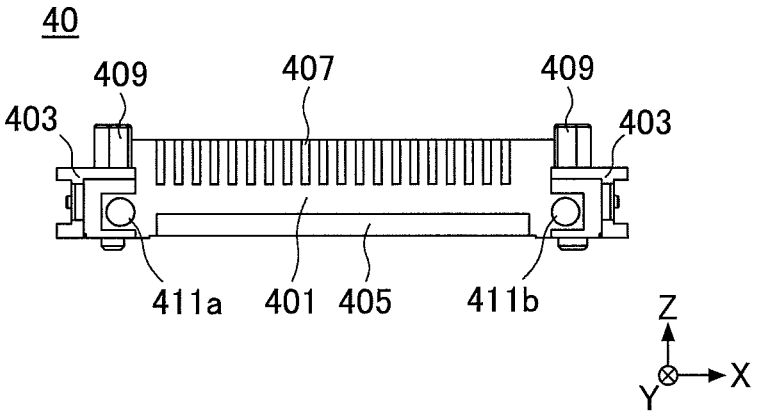
FIG. 10B is an elevation view of the first fixed housing of the embodiment.
Figure 10C:
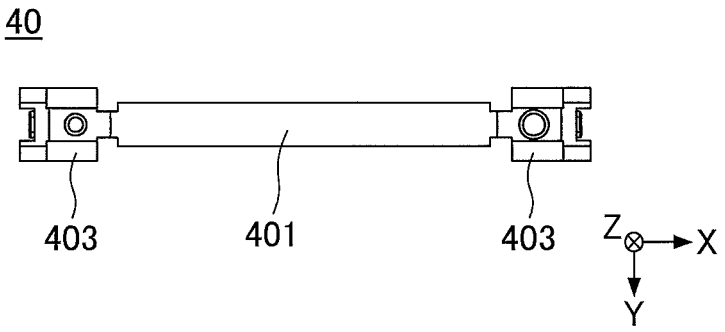
FIG. 10C is a bottom view of the first fixed housing of the embodiment.
Figure 10D:
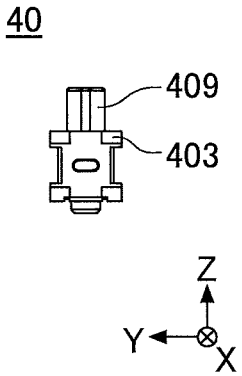
FIG. 10D is a side view of the first fixed housing of the embodiment.

FIG. 10A is a top view, FIG. 10B is an elevation view, FIG. 100 is a bottom view and FIG. 10D is a side view, of the first fixed housing 40.

The first fixed housing 40 includes a center portion 401 that draws in the X direction in an upper plane view, and side end portions 403 provided at both ends of the center portion 401 in the X direction. The first fixed housing 40 is placed between the two columns of contacts provided in the connector 1 and is fixed to the substrate with the second fixed housing 50.

The center portion 401 includes first receiving portions 407 each formed in a groove form along the Z direction, and sandwiching portions 405 each stepwisely protruded in the Z direction, at both side surfaces in the Y direction. The first receiving portions 407 are provided at an upper portion of the center portion 401 to receive the first spring portions 105*a* of the first contacts 10, respectively, to prevent the first spring portion 105*a* that elastically deforms from contacting the adjacent another first spring portion 105*a* or the like. The sandwiching portions 405 are provided at a lower portion of the center portion 401 and sandwich the first fixed portion 109 of the first contact 10 and the first fixed portion 209 of the second contact 20 with the second fixed housing 50.

Protruding portions 409 that protrude upwardly from the side end portions 403 are inserted in the hole portions 307 of the floating housing 30, respectively. The displacement amount of the floating housing 30 is limited to a range such that the protruding portion 409 of the first fixed housing 40 does not contact an inner wall of the respective hole portion 307. By limiting the displacement amount of the floating housing 30, damage or the like of the first contacts 10 and the second contacts 20 by an excessive load due to the large displacement of the floating housing 30, for example, can be prevented.

Fixed pins provided at the second fixed housing 50 that is fixed at side surfaces of the first fixed housing 40 are inserted in through holes 411*a* and 411*b* provided at the side end portions 403.

(Second Fixed Housing)

Figure 11A:
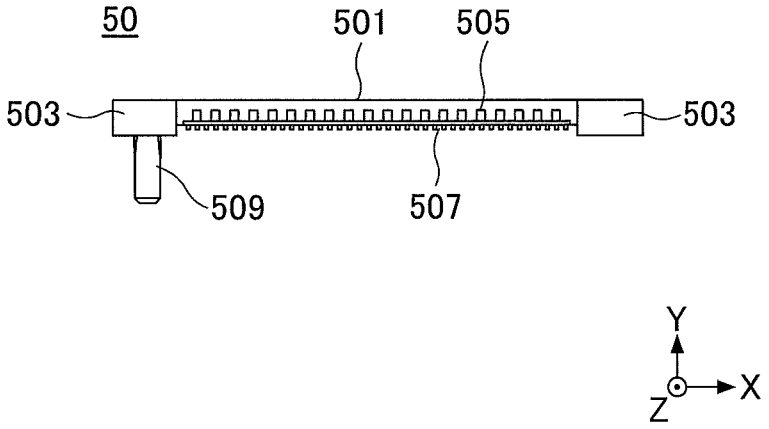
FIG. 11A is a top view of a second fixed housing of the embodiment.
Figure 11B:
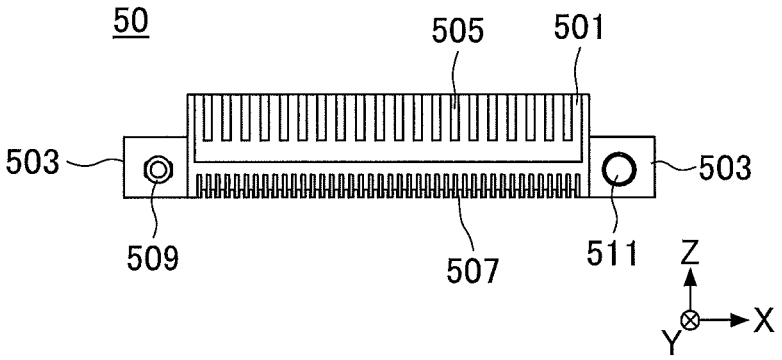
FIG. 11B is an elevation view of the second fixed housing of the embodiment.
Figure 11C:
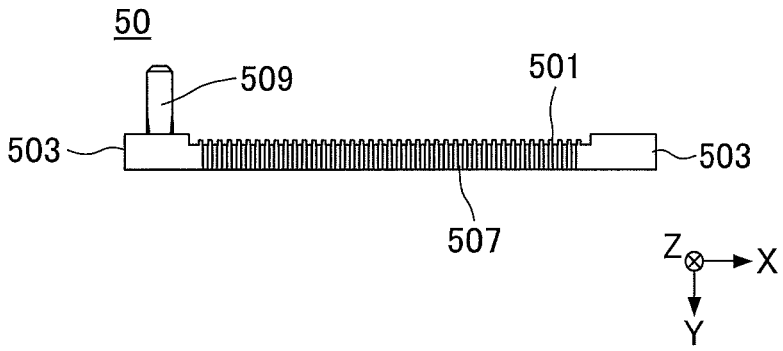
FIG. 11C is a bottom view of the second fixed housing of the embodiment.
Figure 11D:
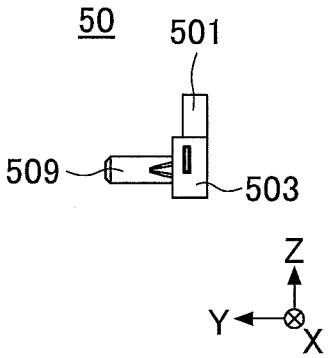
FIG. 11D is a side view of the second fixed housing of the embodiment.

FIG. 11A is a top view, FIG. 11B is an elevation view, FIG. 11C is a bottom view and FIG. 11D is a side view, of the second fixed housing 50.

The second fixed housing 50 includes a center portion 501 that draws in the X direction in an upper plane view, and side end portions 503 provided at both ends of the center portion 501 in the X direction, and the second fixed housing 50 is fixed to a side surface of the first fixed housing 40.

The center portion 501 includes second receiving portions 505 each formed in a groove form along the Z direction and contact grooves 507. The second receiving portions 505 are provided at an upper portion of the center portion 501 at one side surface in the Y direction to receive the first spring portions 205*a* of the second contact 20, respectively, to prevent the second spring portion 205*a* that elastically deforms from contacting the adjacent another second spring portion 205*a* or the like.

The contact grooves 507 are provided at a lower portion of the center portion 501 at the one side surface in the Y direction to extend to the bottom surface of the center portion 501. The first contacts 10 and the second contacts 20 are inserted in the contact grooves 507. The contact grooves 507 sandwich the first fixed portions 109 of the first contacts 10 and the first fixed portions 209 of the second contacts 20 with the sandwiching portion 405 of the first fixed housing 40. Further, the second fixed portions 113 of the first contacts 10 and the second fixed portions 213 of the second contacts 20 are pushed in the contact grooves 507 at the bottom surface.

A fixed pin 509 that protrudes in the Y direction is provided at one of the side end portions 503 at a side where the second receiving portions 505 and the contact grooves 507 are provided. Further, a fixed hole 511 is provided at the other of the side end portions 503.

As illustrated in FIG. 2 to FIG. 4, one of the second fixed housings 50 is provided at each of both sides of the first fixed housing 40 to sandwich the first contacts 10 and the second contacts 20 between the first fixed housing 40 and to be fixed to the first fixed housing 40.

As illustrated in FIG. 2, the second fixed housing 50*a* is fixed to the first fixed housing 40 with the second fixed housing 50*b* as the fixed pin 509*a* penetrates the through hole 411*b* of the first fixed housing 40 and is pushed in the fixed hole 511*b* of the second fixed housing 50*b*. Further, similarly, the second fixed housing 50*b* is fixed to the first fixed housing 40 with the second fixed housing 50*a* as the fixed pin 509*b* penetrates the through hole 411*a* of the first fixed housing 40 and is pushed in the fixed hole 511*a* of the second fixed housing 50*a*.

As described above, the first fixed housing 40 and the second fixed housing 50 sandwich the first fixed portions 109 of the first contacts 10 and the first fixed portions 209 of the second contacts 20 and are fixed to the substrate with the first contacts 10 and the second contacts 20.

As illustrated in FIG. 12 and FIG. 13, the first fixed housing 40 is placed between the two columns of contacts, and the second fixed housings 50*a* and 50*b* are fixed to the first fixed housing 40 while sandwiching the first contacts 10 and the second contacts 20. Further, the first receiving portions 407 of the first fixed housing 40 receive the first spring portions 105*a* of the first contacts 10, and the second receiving portions 505 of the second fixed housing receive the first spring portions 205*a* of the second contacts 20, respectively. Each of the first receiving portions 407 and the second receiving portions 505 prevents the adjacent first spring portions 105*a* and 205*a* from contacting with each other by surrounding each of the first spring portions 105*a* and 205*a* that elastically deforms by a partition wall. Further, by forming the first spring portion 105*a* of the first contact 10 and the first spring portion 205*a* of the second contact 20 to be folded in directions that are apart from each other, and placing the first spring portion 105*a* of the first contact 10 and the first spring portion 205*a* of the second contact 20 to be apart from each other (apart from each other by $D_{12}$-$D_{11}$ for the example of FIG. 5 to FIG. 80), contact between the adjacent first spring portion 105*a* of the first contact 10 and the first spring portion 205*a* of the second contact 20 is prevented.

As described above, according to the connector 1 of the embodiment, the floating housing 30 is displaceable in various directions with respect to the substrate, and connection reliability is improved by absorbing the positional displacement with respect to the counterpart connector that occurs in various directions. Further, contact between the spring portions 105 and 205 of the adjacent first contact 10 and the second contact 20 is prevented. Thus, the alignment space between the first contact 10 and the second contact 20 can be made narrower so that the connector 1 can be made small.

Although a preferred embodiment of the connector has been specifically illustrated and described, it is to be understood that minor modifications may be made therein without departing from the spirit and scope of the invention as defined by the claims.

The present application is based on and claims the benefit of priority of Japanese Priority Application No. 2014-114184 filed on Jun. 2, 2014, the entire contents of which are hereby incorporated by reference.

NUMERALS

1 connector
10 first contact
20 second contact
30 floating housing
40 first fixed housing
50 second fixed housing
101, 201 contacting portion
103, 203 bending portion
115, 215 lead portion
105, 205 spring portion
105*a*, 205*a* first spring portion
105*b*, 205*b* second spring portion
407 first receiving portion
505 second receiving portion

What is claimed is:

1. A connector comprising:

a plurality of contacts each including a contacting portion, provided at one end, that contacts a counterpart connector, a lead portion, provided at another end, that contacts a substrate, and a spring portion, provided between the contacting portion and the lead portion, that elastically deforms;

a floating housing, fixed to the contacting portions of the plurality of contacts that are aligned in two columns of contacts, that fits with the counterpart connector;

a first fixed housing, provided between the two columns of contacts, that is fixed to the substrate, and a second fixed housing, fixed to the first fixed housing, that sandwiches a portion adjacent to the lead portion of each of the plurality of contacts with the first fixed housing.

2. The connector according to claim 1, wherein the plurality of the contacts are formed from a single plate metal member, and wherein the spring portion includes a first spring portion including a curved portion protruding in a first direction, and a second spring portion connected to the first spring portion and including a curved portion protruding in a second direction perpendicular to the first direction.

3. The connector according to claim 2, wherein the plurality of contacts include first contacts in each of which a curved portion of the first spring portion protrudes in a first thickness direction that is parallel to a thickness direction of the contacting portion, and second contacts in each of which a curved portion of the first spring portion protrudes in a second thickness direction that is opposite from the first thickness direction, and wherein the first contacts and the second contacts are alternatively placed in each of the columns of contacts.

4. The connector according to claim 3, wherein the first fixed housing includes first receiving portions each of which individually receives the first spring portion of each of the first contacts, and wherein the second fixed housing includes second receiving portions each of which individually receives the first spring portion of each of the second contacts.

5. The connector according to claim 3, wherein each of the first contacts and the second contacts includes a bending portion between the contacting portion and the spring portion, and wherein the bending portion of each of the first contacts and the bending portion of each of the second contacts are configured such that the distance between the contacting portion and the second spring portion of the first contact becomes smaller than the distance between contacting portion and the second spring portion of the second contact in a thickness direction of the contacting portion.

6. The connector according to claim 2, wherein the spring portion includes a plurality of first spring portions, wherein the second spring portion is provided between the plurality of the first spring portions to connect the plurality of the first spring portions, and wherein the curved portion of each of the first spring portions protrudes in a direction perpendicular to a drawing direction of the contacting portion, a thickness direction of the curved portion being perpendicular to a thickness direction of the contacting portion.

* * * * *